US011540570B1

(12) United States Patent
Dodson

(10) Patent No.: US 11,540,570 B1
(45) Date of Patent: Jan. 3, 2023

(54) MULTI-LAYERED MOISTURE WICKING SWEAT ABSORBING WRISTBAND

(71) Applicant: Jenifer Dodson, Lakewood, CA (US)

(72) Inventor: Jenifer Dodson, Lakewood, CA (US)

( * ) Notice: Subject to any disclaimer, the term of this patent is extended or adjusted under 35 U.S.C. 154(b) by 219 days.

(21) Appl. No.: 17/007,927

(22) Filed: Aug. 31, 2020

Related U.S. Application Data

(60) Provisional application No. 62/931,251, filed on Nov. 6, 2019.

(51) Int. Cl.

| | |
|---|---|
| ***A41D 20/00*** | (2006.01) |
| ***A41D 31/12*** | (2019.01) |
| ***A41D 31/30*** | (2019.01) |
| ***A41D 13/08*** | (2006.01) |

(52) U.S. Cl.
CPC ..... *A41D 20/00* (2013.01); *A41D 13/088* (2013.01); *A41D 31/125* (2019.02); *A41D 31/305* (2019.02)

(58) Field of Classification Search
CPC .... A41D 20/00; A41D 31/125; A41D 31/305; A63B 71/14
See application file for complete search history.

(56) References Cited

U.S. PATENT DOCUMENTS 699,802 A * 5/1902 Mendelsohn ..... A41D 20/00 D2/858
2,778,027 A * 1/1957 Bacon ..... A41D 19/0041 2/270
4,843,653 A * 7/1989 Coble ..... D04B 1/22 2/169
5,070,544 A * 12/1991 Aliberti ..... A41B 7/00 2/232
5,298,001 A 3/1994 Goodson
5,444,871 A * 8/1995 Lopez ..... A41D 13/1227 2/114
5,592,694 A 1/1997 Yewer, Jr.
5,810,753 A * 9/1998 Eberbach ..... A61F 5/0118 602/20
5,864,886 A * 2/1999 Gregory, minor ..... A41D 13/08 2/170
5,878,435 A 3/1999 Kast et al.
5,887,277 A 3/1999 Lohman
5,987,641 A * 11/1999 Walker ..... A41D 13/088 2/161.1
6,146,319 A 11/2000 Tarail
6,192,519 B1 2/2001 Coalter
6,430,744 B1 8/2002 Redman et al.
(Continued)

*Primary Examiner* — Khaled Annis
(74) *Attorney, Agent, or Firm* — John Rizvi; John Rizvi, P.A.—The Patent Professor

(57) ABSTRACT

A multi-layered moisture-wicking sweat-absorbing wristband that is used in conjunction with a gymnastic grip. The multi-layered wristband generally comprises a garment forming a tubular body having a first portion and a second portion. The first portion of the tubular body includes a first opening and the second portion includes a second opening. The first portion of the garment may include a first layer, a second layer, and at least one inner layer between the first and second layer. The second portion of the garment may include a third layer and a fourth layer. The garment is configured to be disposed over the wrist of a user with the second portion of the tubular body folded over a grip that is attached to the user and the first portion of the tubular body.

11 Claims, 9 Drawing Sheets

(56) References Cited

U.S. PATENT DOCUMENTS 6,449,772 B1 9/2002 Donner
6,708,733 B2 * 3/2004 Iizuka ..... D04B 1/22 139/383 B
7,200,870 B1 4/2007 Kolk
8,216,169 B2 7/2012 Koby et al.
9,901,130 B2 2/2018 Morris
10,076,144 B2 9/2018 Rivera
10,092,437 B2 10/2018 Brandt et al.
10,306,936 B2 6/2019 Kreft
10,376,768 B2 8/2019 Schwanke et al.
11,224,792 B2 * 1/2022 Rhodes ..... A41D 13/0568
2002/0193719 A1 * 12/2002 Yewer, Jr. ..... A61F 5/0118 602/21
2003/0199364 A1 * 10/2003 Mah ..... A63B 21/4019 482/23
2003/0221241 A1 * 12/2003 Rivera ..... A41D 20/005 2/170
2005/0081273 A1 * 4/2005 Ota ..... A63B 71/14 2/17
2006/0247108 A1 11/2006 Rastegar et al.
2007/0000004 A1 1/2007 Schleicher et al.
2007/0119462 A1 5/2007 Shumate, Sr. et al.
2009/0205106 A1 * 8/2009 Sohn ..... A61F 5/0118 607/114
2009/0307819 A1 * 12/2009 Joung ..... A63B 71/143 2/16
2011/0167536 A1 7/2011 Kellerhals
2011/0179542 A1 * 7/2011 Khuong ..... A41D 13/088 2/16
2012/0031938 A1 2/2012 Ballew
2013/0212773 A1 8/2013 Marusteri et al.
2014/0215686 A1 8/2014 McMakin, Jr.
2015/0150323 A1 6/2015 Basik
2015/0282537 A1 10/2015 Best et al.
2016/0037840 A1 * 2/2016 Basik ..... A41D 20/00 2/170
2016/0242480 A1 * 8/2016 Mata ..... A41D 20/00
2016/0262470 A1 * 9/2016 Blythe ..... D04B 1/12
2018/0014587 A1 1/2018 Enderlin
2018/0140929 A1 * 5/2018 Pellegrino ..... A63B 71/141
2019/0037938 A1 * 2/2019 Hong ..... A41D 19/015
2019/0142087 A1 * 5/2019 Kelly ..... C08L 1/02 2/170
2019/0281910 A1 * 9/2019 Mata ..... B32B 5/024
2020/0029636 A1 * 1/2020 Kelly ..... A41D 20/00

* cited by examiner

MULTI-LAYERED MOISTURE WICKING SWEAT ABSORBING WRISTBAND

CROSS-REFERENCE TO RELATED APPLICATIONS

This application claims the benefit of U.S. Provisional Patent Application Ser. No. 62/931,251, filed on Nov. 6, 2019, which is incorporated herein in its entirety.

FIELD OF THE INVENTION

The present invention generally relates to wristbands, and more particularly, to a pair of multi-layered moisture-wicking sweat-absorbing wristbands that may be used in conjunction with gymnastic grips.

BACKGROUND OF THE INVENTION

The sport of gymnastics originated in the Greek Hellenistic period were the Greeks exhibited their physical traits of strength, ability, and concentration. Initially, the sport of gymnastics was used to develop the strength and endurance necessary for hand-to-hand combat. Over time, however, the practice of gymnastics transitioned from a military exercise into everyday civilian life. The transition from military to private life was due, in part, thanks to the Greek Olympic Games.

In 1896, gymnastics earned its spot in the first summer Olympic Games and has been an official Olympic sport ever since. Like many of the traditional sports, gymnastics made significant advancements in the early 19th century when new exercises surfaced, such as the pommel horse, horizontal bar, parallel bar, balance beam, ladder, and vaulting horse. Gymnastics is one of the world's most famous Olympic Games, drawing millions of people to watch the top athletes of every nation compete for a medal.

Becoming a gymnast, however, is no easy feat. The sport of gymnastics requires an incredible amount of discipline, toughness, dedication, and balance. To have an opportunity to become an elite gymnast, the gymnast must work on his or her craft for six to eight hours a day, six to seven days a week. One of the most challenging skills to master and score high when competing are the uneven bars.

The uneven bars are bars that are parallel to each other and set at different heights, with the lower bar being at about five feet above the ground and the higher bar being about eight feet above the ground. The distance, or width, between the bars, is approximately six feet. Some of the most recognizable skills on the uneven bars include but are not limited to, release moves, pirouettes, and circles. In a release move, the gymnast lets go of the bar and then re-grasps it. He or she can perform a release move from the high bar to the low bar, from the low bar to the high bar, or on the same bar. In a pirouette, the gymnast turns on her hands while in the handstand position. She may use a variety of different hand positions during the turn. In circles, such as giants and free hip circles, the gymnast circles the bar, either stretched out in a handstand or with his or her hips close to the bar. All of these moves take a great deal of skill to perform. In almost all cases, gymnasts use grips when performing on the uneven bars.

Grips are a wide strip of leather joined to a wrist strap that is worn by the gymnast. The leather strip, which covers and protects the palm of the gymnast's hand, has finger holes at one end. The wrist strap secures the grip to the gymnast's wrist and helps transfer the gymnast's body weight from the finger to the wrist, reducing the load on the gymnast's fingers. Although grips help with weight transfer, grips are primarily used to enhance the gymnast's grip on the bars (or an alternative apparatus) and reduce friction between the apparatus and the gymnast's palms, which can cause painful blisters and rips (i.e., outer layer skin separation).

As an added measure against unwanted friction between the gymnast's hands and an apparatus, a gymnast uses powdered chalk to absorb the sweat form his or her hands. Dry hands ensure a reliable and secure grip that prevents slippage. In many instances, however, as the gymnast is performing sweat dissolves the chalk in its entirety. Since the gymnast is not allowed to reapply a layer of chalk in the middle of a performance, the gymnast is susceptible to added friction or slippage that may affect his or her performance.

Accordingly, there is an established need for a device that overcomes the limitations of chalk and other types of sweat absorption devices that do not work to solve the associated problems that remain unsolved.

SUMMARY OF THE INVENTION

The present invention is directed to a multi-layered moisture-wicking sweat-absorbing wristband that is used in conjunction with a gymnastic grip. The multi-layered wristband keeps the user's wrists dry, which eliminates one of the major causes of rips (friction and moisture) on the wrist. Additionally, the wristband lessons the friction of the buckle portion of the grip against the wrist.

Introducing a first embodiment of the invention, the present invention consists of a multi-layered moisture-wicking sweat-absorbing wristband, comprising:

a wearable article generally providing a tubular body having a first portion and a second portion, the first portion having a first opening and the second portion having a second opening, the tubular body configured to be disposed over the wrist of a user.

In another aspect, the first portion may provide a first layer, a second layer, and at least one inner layer between the first and second layer of the first portion.

In another aspect, the second portion may provide a third layer and a fourth layer, the third layer superposing the fourth layer.

In another aspect, the first portion of the tubular body may be of a thicker thickness than the second portion.

In another aspect, the second portion may be foldable onto the first portion of the tubular body creating a crease.

In yet another aspect, at least five-layers are disposed over the user's wrist when the second portion is folded over the first portion of the tubular body.

In yet another aspect, at least two inner layers may be interposed between the first and second layer of the first portion.

In another aspect, the at least one inner layer may be made out of a sweat absorbing material.

In another aspect, the first and second layer of the first portion and the third and fourth layer of the second portion may be made out of a moisture wicking material.

In yet another aspect, a gymnastic grip may be used in conjunction with the garment, wherein the gymnastic grips may be attached to the user's wrist by latching the grip's buckles to the user's wrist over the first portion of the tubular body, such that the grip's buckles encircle the entire wrist of the user.

In yet another aspect, the gymnastic grip may be worn over the first portion of the tubular body and the second portion folded over the first portion and gymnastic grip, such that the gymnastic grip is between the first portion and the second portion of the tubular body of the Garment.

Introducing a second embodiment of the invention, the present invention consists of a multi-layered moisture-wicking sweat-absorbing wristband, comprising:

a garment following a tubular body having a first opening and a second opening, the tubular body comprising;

a first portion, the first portion includes a first layer, a second layer, and at least one inner layer between the first layer and the second layer, a second portion continuous with the first portion, the second portion including a third layer and a fourth layer, wherein the tubular body of the garment is configured to be disposed over the wrist of a user, wherein a gymnastic grip is attached to the user's wrist over the first portion of the tubular body, and wherein the second portion of the tubular body is foldable over the gymnastic grip attached to the user's wrist and the first portion of the tubular body.

In yet another aspect, the first layer, the at least one inner layer, the second layer, the third layer, and the fourth layer are surrounding the user's wrist when the second portion is folded over the first portion of the garment's tubular body.

In yet another aspect, the first layer, the second layer, the third layer, and the fourth layer may be made out of an anti-bacterial material.

In yet another aspect, a method for providing and using a multi-layered moisture-wicking sweat-absorbing wristband comprises the steps of:

providing a garment having a tubular body having a first portion and a second portion, the first portion having a first opening and the second portion having a second opening, wherein the first portion includes a first and second layer, and the second portion having a third and fourth layer;

providing at least one inner layer between the first and second layer of the first portion of the tubular body;

inserting the user's hand through the second opening of the second portion of the tubular body until the first opening of the first portion of the tubular body is about the base of the user's palm;

attaching a grip over the first portion of the garment that s covering the user's wrist; and folding the second portion of the tubular body over the grip and the first portion of the tubular body, such that the grip is between the first portion and the second portion of the garment.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a multi-layered moisture-wicking sweat-absorbing wristband garment (hereinafter referred to as "garment") that is designed to keep the wrists of a user dry' when performing on an apparatus. Unlike other products that deform and deteriorate after multiple uses, the garment of the present invention does not deform and deteriorate after continuous use because of the way it is design and constructed. The garment is also designed to be used in conjunction with gymnastic grips and maintain the position of the gymnastic grip in the correct place while the user performs.

Figure 1:
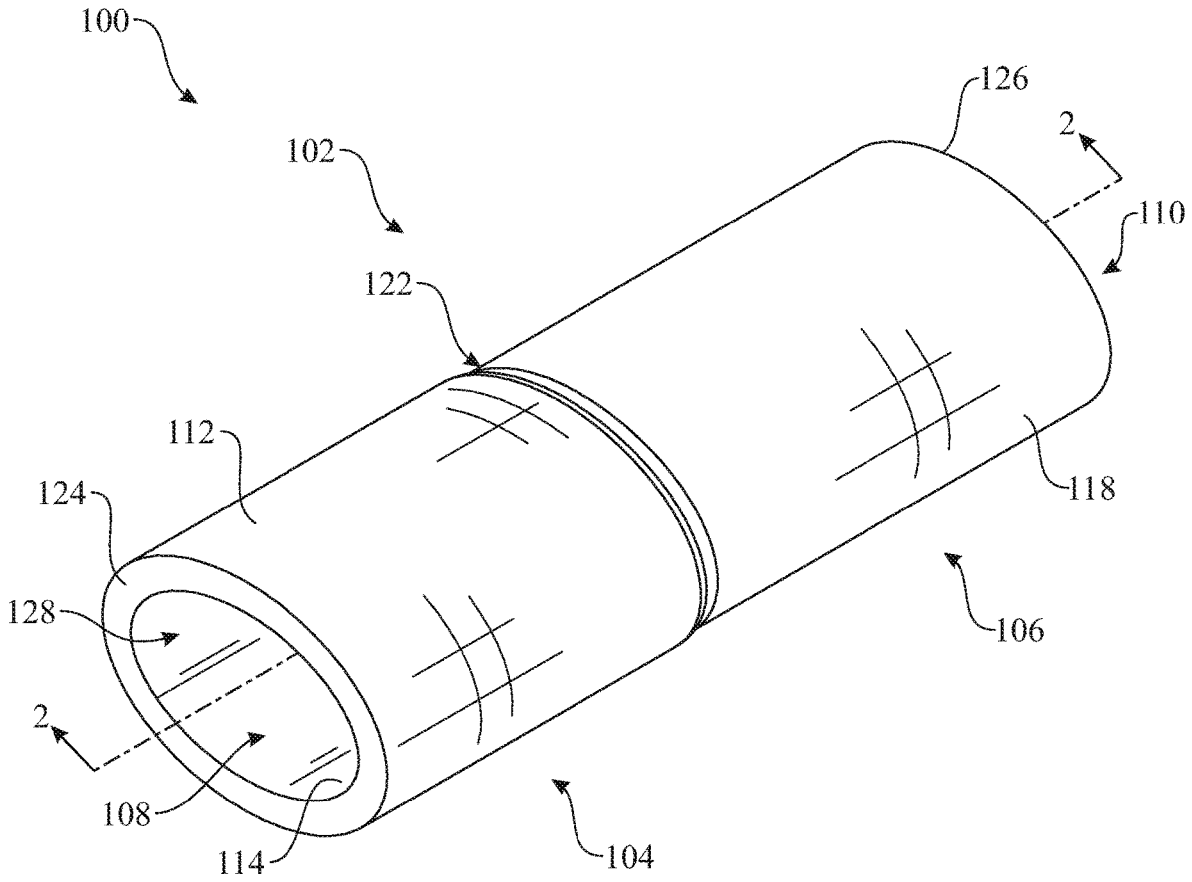
FIG. 1 presents a presents an isometric view of a first embodiment of the multi-layered moisture-wicking sweat-absorbing wristband of the present invention.
Figure 2:
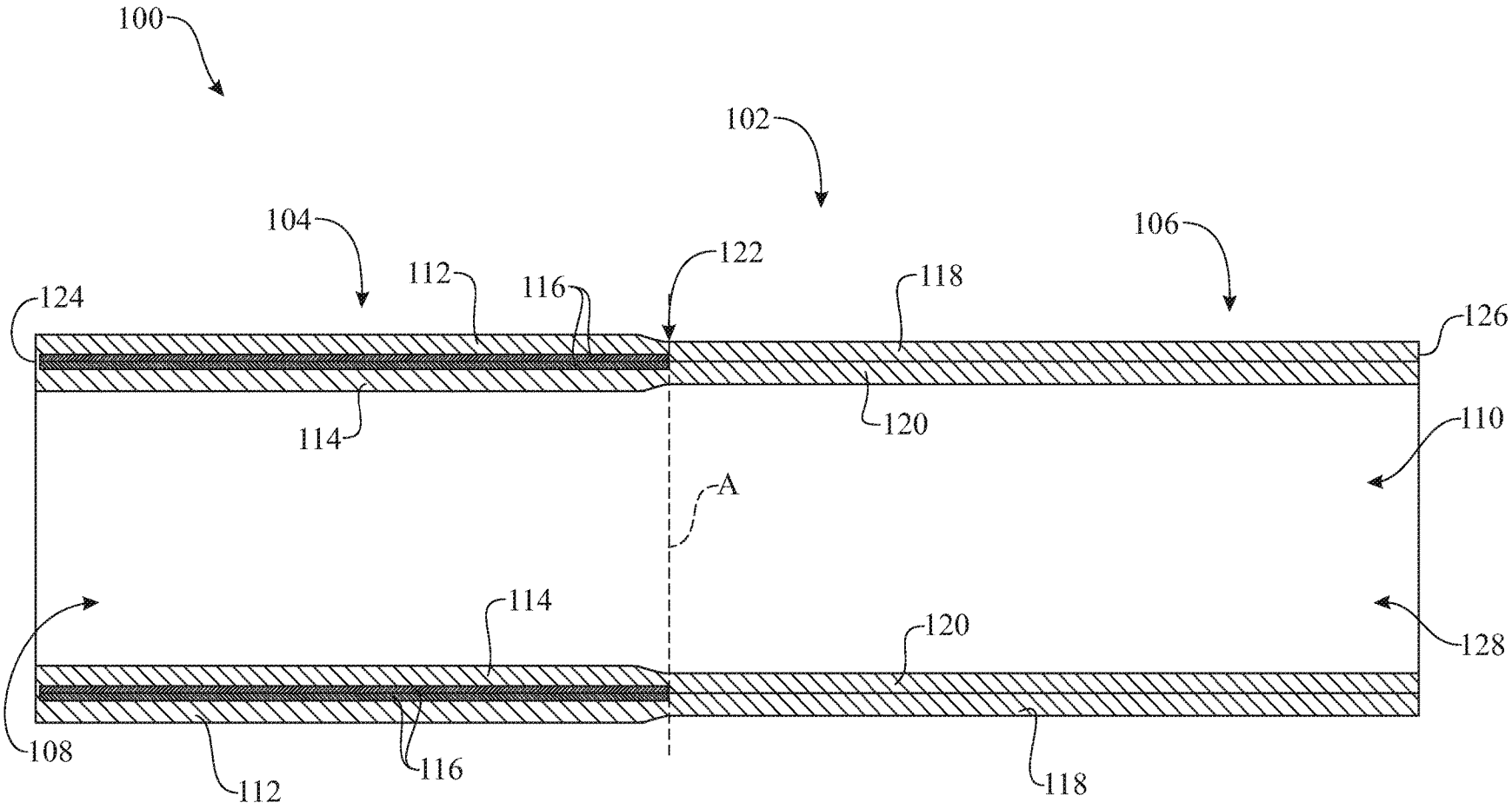
FIG. 2 presents a cross-section view of the multi-layered moisture-wicking sweat-absorbing wristband taken along section line 2-2 in FIG. 1.
Figure 3:
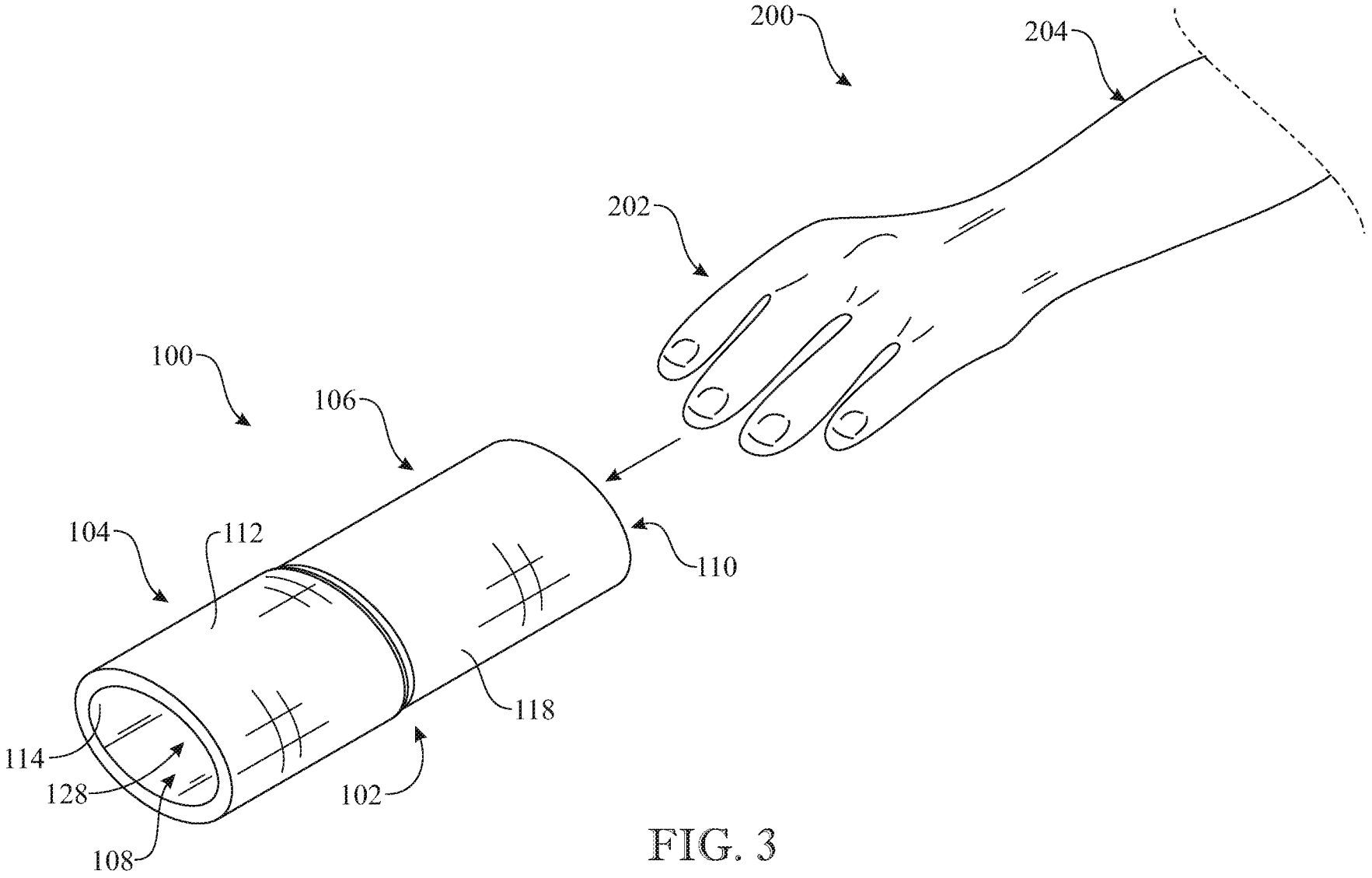
FIG. 3 presents how the multi-layered moisture-wicking sweat-absorbing wristband is slid onto a user's arm.

Referring initially to FIGS. 1 and 2, a garment 100 is generally shown. The garment 100 comprises of a tubular body 102 that includes a first portion 104 and a second portion 106 defining a distal end 124 and a proximal end 126, and has a hollow interior 128 configured to receive a user's arm therein. The first portion 104 of the garment 100 provides a first opening, and includes a first layer 112, a second layer 114, and at least one inner layer 116. As shown in FIG. 2, in one exemplary form, there may be two inner layers interposed between the first layer 112 and the second layer 114 of the garment 100. The inner layers 116 extend from the distal end 124 of the tubular body 102 to about a crease line 122 defined by a folding axis A.

In one exemplary form, the inner layers 116 of the garment 100 may be made out of moisture absorbing material designed to absorb and capture sweat. This includes, but is not limited to, bamboo natural fibers, synthetic fibers, polyester, nylon, and poly blends. The first layer 112 and second layer 114 of the first portion 104 of the tubular body 102 may be made out of an anti-bacterial material that prevents bacteria from growing on its surface. The layering is also machine-washable and does not deform or deteriorate after extended use. The anti-bacterial layering may be made out of a variety of textiles, including but not limited to, polyester, polyester-vinyl composites, vinyl, and acrylics.

The second portion 106 of the tubular body 102 of the garment 100 may include a third layer 118 and a fourth layer 120 with no inner layer interposed between them. Similarly to the first and second layering 112, 114, the third layer 118 and the fourth layer 120 may be made out of an anti-bacterial material. The material may include but not limited to, polyester, polyester-vinyl composites, vinyl, and acrylic. As is best illustrated in FIG. 2, the first portion 104 of the garment 100 is of a greater thickness than the second portion 106, making the second portion 106 more pliable than the first portion 104. The first layer 112, second layer 114, the at least one inner layer 116, third layer 118, and fourth layer 120 of the tubular body 102 may be bonded together through mechanical bonding, chemical bonding, thermodynamic bonding, or hydrogen bonding to form one unitary body. Alternatively, the layers of the tubular body 102 of the garment may be stitched together to form the one unitary body.

Figure 4:
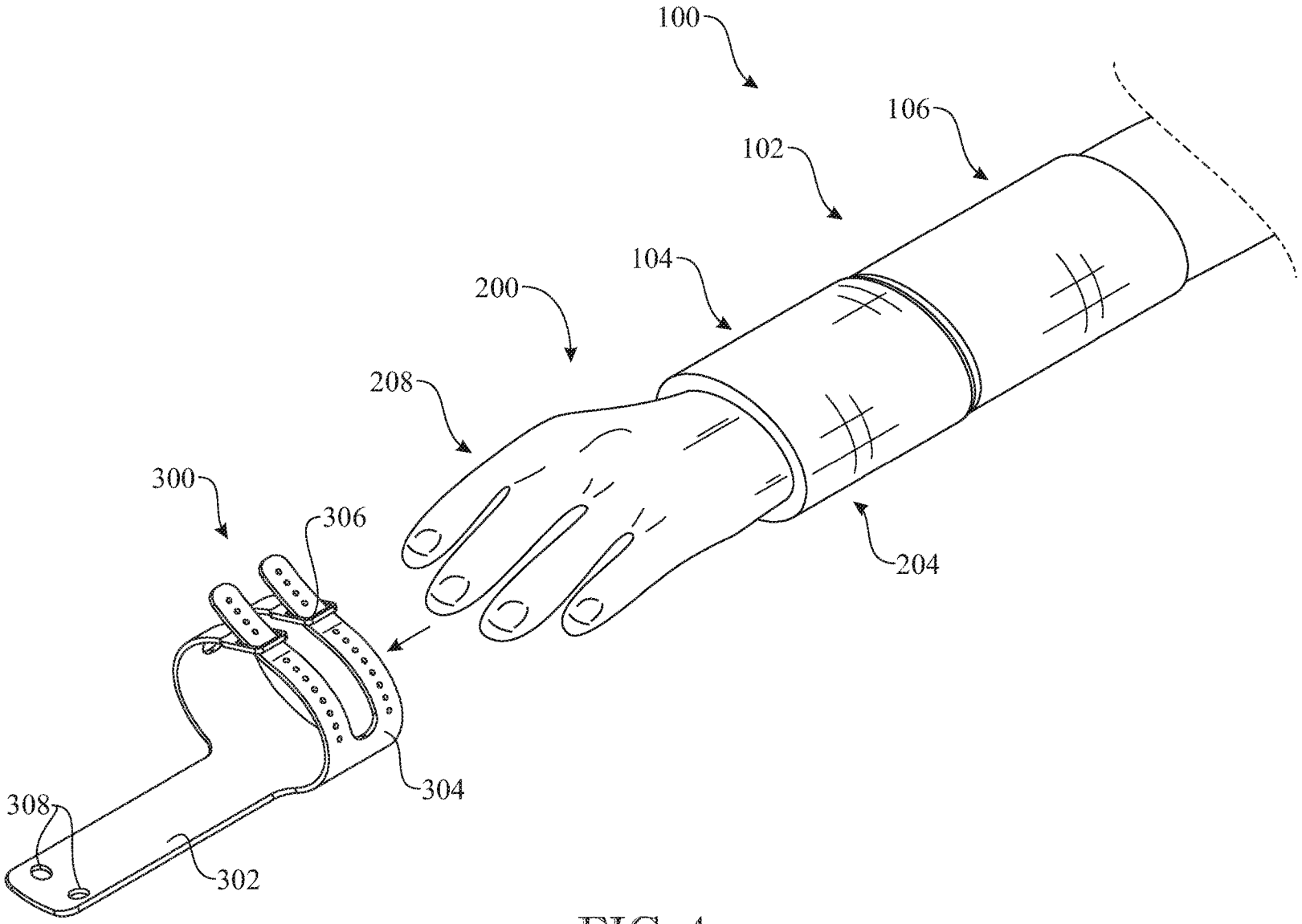
FIG. 4 presents the multi-layered moisture-wicking sweat-absorbing wristband donned over a user's arm.

With reference to FIG. 4, the garment 100 of the present invention is designed to be used in conjunction with (gymnastic) grips 300. Generally, gymnastic grip's 300 comprise a palm strip 302 that covers the palm area of a user's hand 202. The grip 300 also comprises a wrist strap 304 that includes a fastener 306, such as a strap and buckle, which encircles the wrist 204 of the user 200 to secure the grip 300 to the user's wrist 204. The palm strip 302 may also include a pair of finger holes 308 disposed about its distal end that are designed to receive a pair of the user's fingers 206. As mentioned hereinabove, grips 300 are used to enhance the user's grip when using an apparatus (not shown) by reducing friction, which can lead to painful blisters and rips, on the outer layer of the user's wrist.

Accordingly, FIGS. 3-7 illustrate how to the garment 100 may be used in conjunction with a gymnastic grip 300. An exemplary description is now described.

As is best illustrated in FIGS. 3-7, the user 200 may wear the garment 100 by inserting a hand 202 through the second opening 110 on the proximal end 126 of the second portion 106 of the tubular body 102, through the hollow interior 128 of the tubular body 102, and out of the first opening 108 of the first portion 104 of the garment. The user pulls the garment 100 until the first opening 108 on the distal end 124 of the first portion 104 of the tubular body is about the same level as user's wrist 204. When the garment is in its desired position, the second layer 114 of the first portion 104 should be making contact with the user's wrist 204, and the fourth layer 120 of the second portion 106 of the tubular body 102 should be making contact with the forearm of the user.

Figure 5:
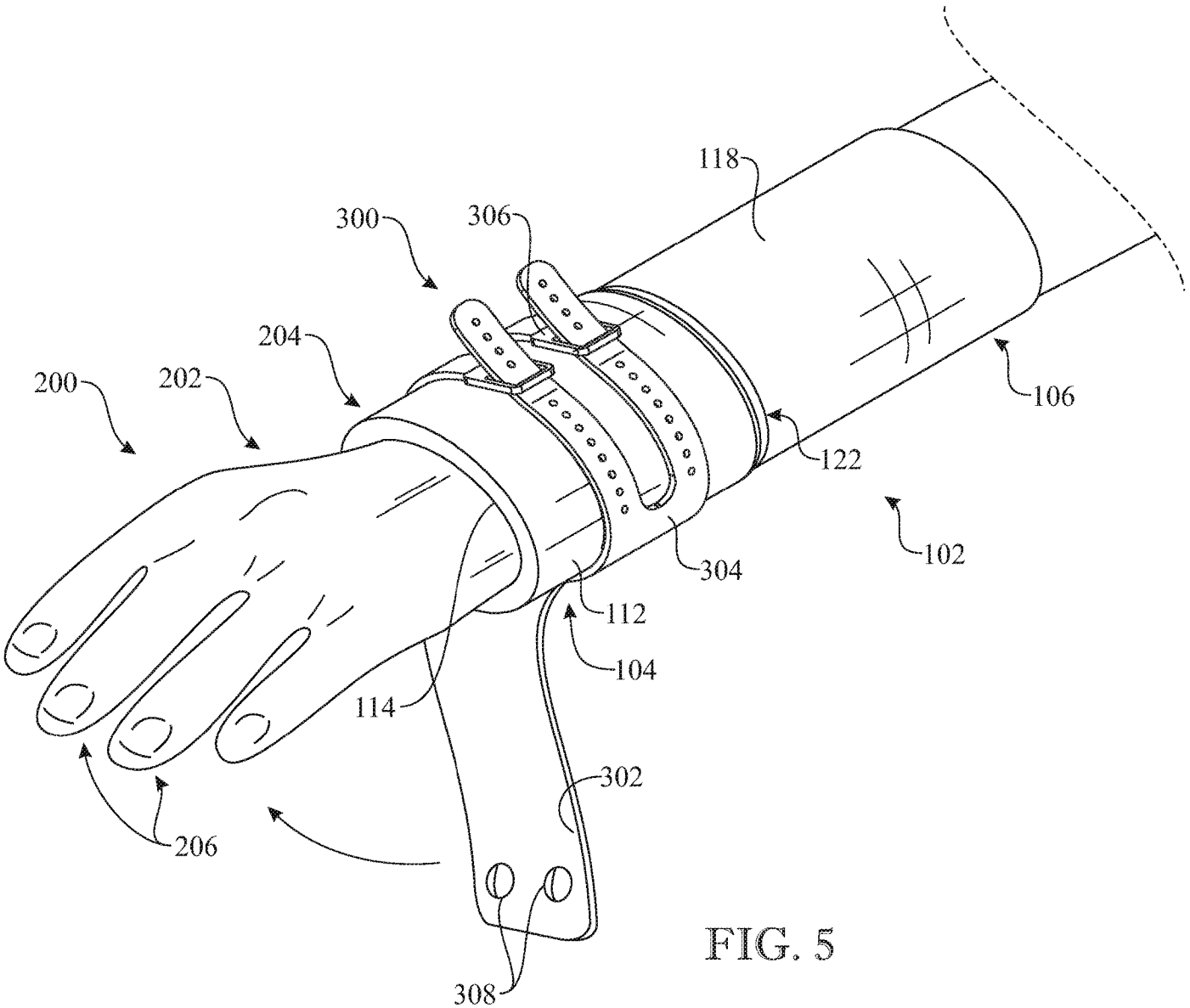
FIG. 5 presents how a grip may be attached to the user's wrist over the multi-layered moisture-wicking sweat-absorbing wristband.
Figure 6:
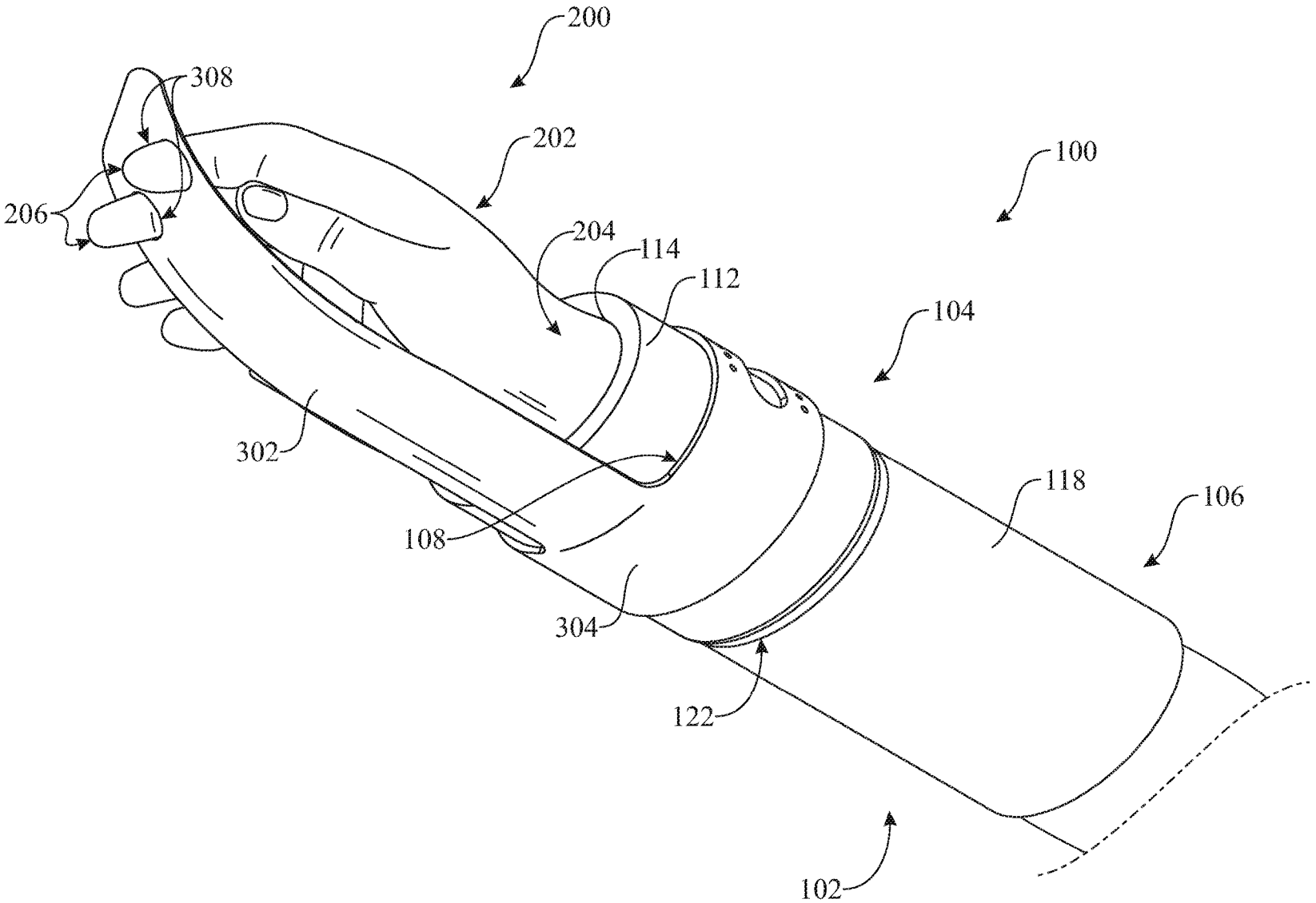
FIG. 6 presents a bottom isometric view of the grip attached the user's arm over the multi-layered moisture-wicking sweat-absorbing wristband originally illustrated in FIG. 5.

Once the garment is in position, the user uses his other hand to put on the grip 300. Referring to FIG. 5, the wrist strap 304 and its fastener 306 is placed on top of the first portion 104 of the garment's tubular body 102, and fastened to the user's wrist 204. Thus, the first portion 104 of the tubular body 102 provides a cushioned buffer between the grip 300 and the user's wrist 204. The wrist strap 304 of the grip 300 encircles the entirety of the first portion 104 of the tubular body 102 and the user's wrist 204 when fastened to the user 300. After the grip is fastened to the user 200, the palm strip 302 of the grip 300 is extended outwardly until the user can inserts a pair of fingers 206 through the finger holes 308 provided on the palm strip 304.

Figure 7:
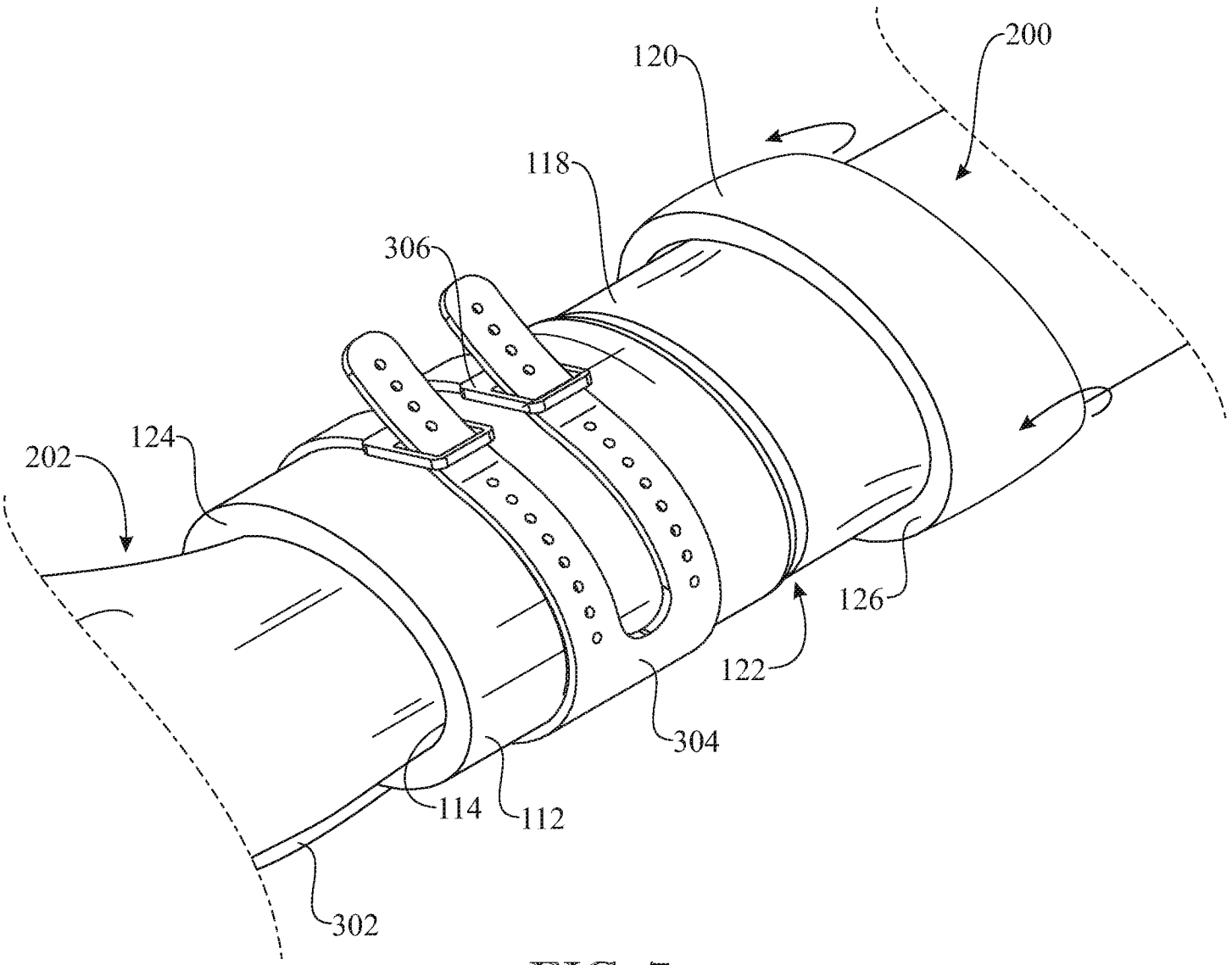
FIG. 7 presents how the second portion of the multi-layered moisture-wicking sweat-absorbing wristband is folded over the grip and first portion of the wristband.
Figure 8:
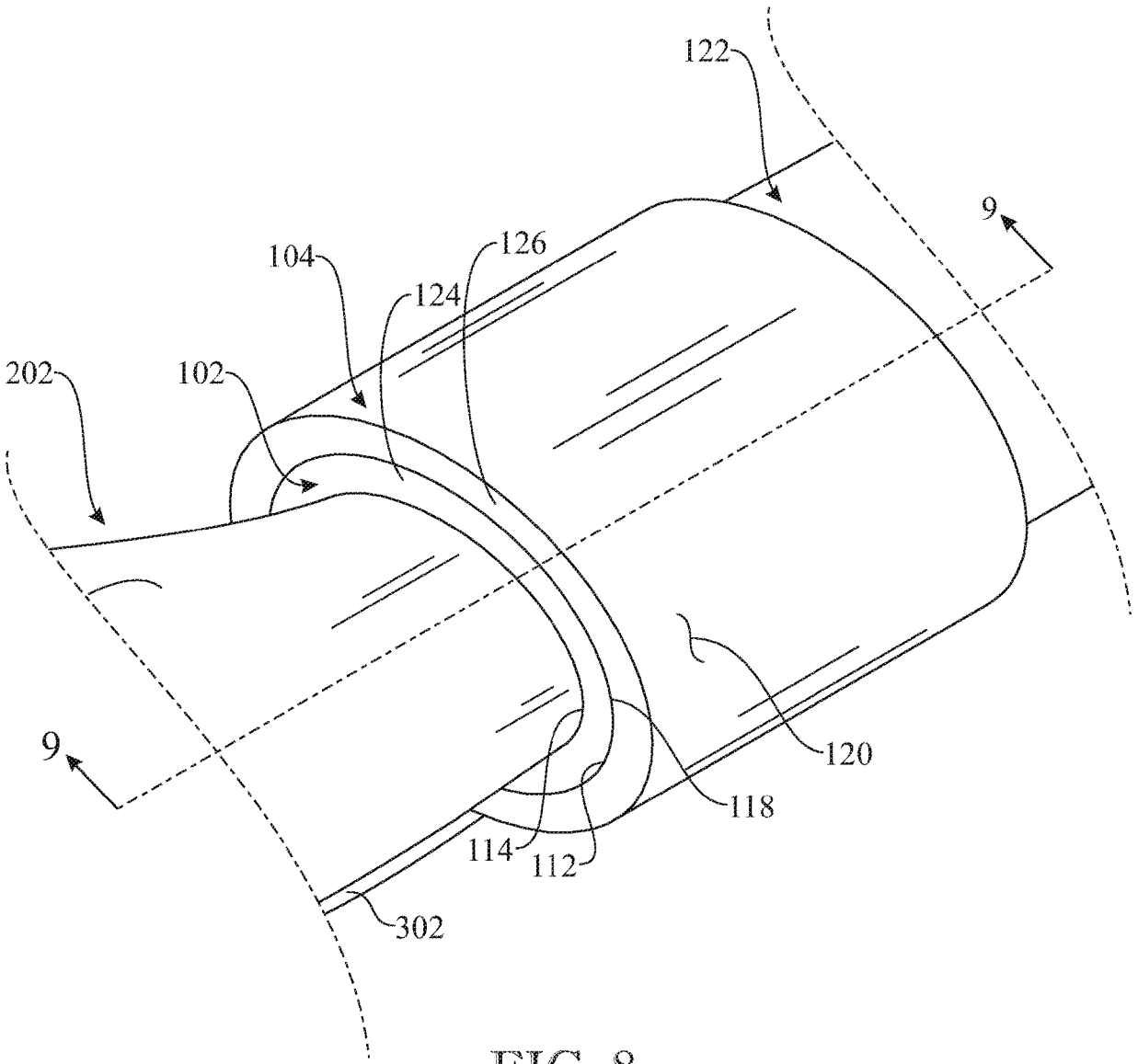
FIG. 8 presents the second portion covering the grip and first portion of the multi-layered moisture-wicking sweat-absorbing wristband.

Referring now to FIGS. 7 and 8, the user 200 is able to cover and protect portions of the grip 300 attached to the user's wrist by using the second portion 106 of the garment 100. This may be done by pulling the proximal end 126 of the tubular body 102 of the garment 100 toward the direction of the distal end 124 of the first portion 102 of the garment. Pulling the second portion 106 toward the first portion 104 converts the fourth layer 120, which was originally an interior layer, into an exterior layer. Consequently, the third layer 118, which was originally an exterior layer, is converted into an interior layer.

As is best illustrated in FIG. 8, during the folding process the second portion 106 of the tubular body 102 is able to completely envelope the wrist strap 304 and fastener 306 of the grip 300, such that the grip's wrist strap 304 and fastener 306 is between the first portion 104 and the second portion 106 of the garment's tubular body 102. The second portion 106 of the tubular body 102 overlays the first portion 104, with the distal end 124 and proximal end 126 of the tubular body in planar alignment.

Figure 9:
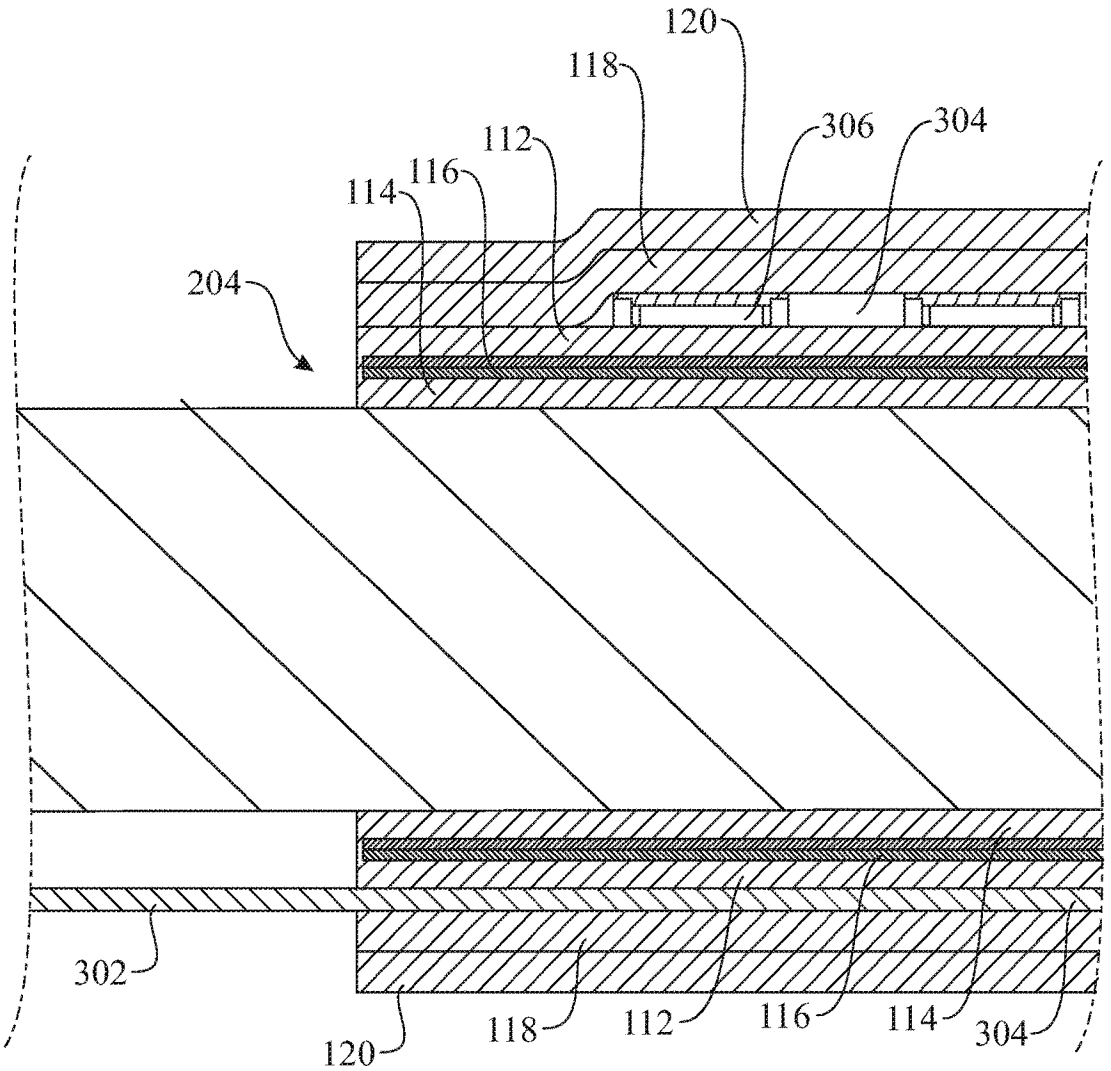
FIG. 9 presents a cross-section view of the layering of the multi-layered moisture-wicking sweat-absorbing wristband between the grips and the user's taken along section line 9-9 in FIG. 8.

Turning now to FIG. 9 illustrates a cross-section view illustrating the garment's layering over the user's wrist when the second portion 106 of the tubular body 102 overlays the first portion 104. As shown, at least five layers may surround the wrist of the user. These layers include but are not limited to, the fourth layer 120 of the second portion 106 being the outmost layer. Following underneath the fourth layer 120 is the third layer 118 of the second portion 106 of the tubular body. Underneath the third layer 118 is the wrist strap 304, palm strip 302, and fastener 306 of the gymnastic grip 300. Next is the first layer 112 of the first portion 104 of the tubular body 102. As is best illustrated, a portion of the gymnastic grip 300 is between the third layer 118 of the second portion 106 of the tubular body 102, and the first layer 112 of the first portion 104 of the tubular body 102. Following the first layer 112 of the first portion 104 may be at least one inner layer 116 followed by the second layer 114 of the first portion 104. It should be readily understood, however, that at least two or more inner layers might be included and disposed between the first and second layer of the first portion of the tubular body 102.

While the garment is worn, the second layer 114 of the garment 100 makes contact with the user's wrist 204. Accordingly, as the user begins to perspire during an activity, the sweat of the user is wicked by the second layer 114. Sweat is also being absorbed by the second layer 114 and transferred to the inner layer 116, preventing sweat from traversing from the user's wrist to the user's hands. Thus, keeping the user's hands dry preventing sweat from causing rips on the user's wrists.

In summary, the inner layer material of the garment is designed to absorb the sweat that seeps through the second layer of the garment that makes contact with the user. The third and fourth layer of the garment apply pressure to the grip strap, thereby preventing any movement and essentially retaining the grip in place. Also, the third and fourth layer provide a cushioned buffer between the grip strap and the user's wrist to provide the user with added comfort.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A multi-layered moisture-wicking sweat-absorbing wristband and gymnastic wristband combination, comprising:

a wristband comprising, a first portion having a first opening, the first portion comprising a first layer, a second layer, and at least one inner layer interposed between the first layer and the second layer, a second portion having a second opening, the second portion comprising a third layer superimposing a fourth layer, wherein the first opening and the second opening are axially aligned and intersect to create a passageway, and a gymnastic grip comprising a palm strip having a pair of finger holes, a wrist strap portion, at least two fastener straps and at least two corresponding fastener buckles extending from the wrist strap portion, wherein the gymnastic wrist strap is wearable and attachable to a wrist using the fastener straps and the fastener buckles.

2. The multi-layered wristband of claim 1, wherein the wrist strap is attached to the wrist of the user over the first portion of the wristband.

3. The multi-layered wrist band of claim 2, wherein the second portion of the wristband is foldable onto the first portion at about a crease line, covering the wrist strap portion, the at least two fasteners traps and the at least two corresponding fastener buckles of the gymnastic grip.

4. The multi-layered wristband of claim 3, wherein the third and fourth layer of the second portion of the wristband apply constant pressure to the gymnastic grip when the second portion is covering the first portion and the gymnastic grip.

5. The multi-layered wristband of claim 3, wherein only the palm strip of the gymnastic strap is exposed when the second portion of the wristband is folded over wrist strap of the gymnastic strap and the first portion of the wristband.

6. The multi-layered wristband of claim 2, wherein the first layer, the second layer, the third layer, and the fourth layer are made out of anti-bacterial growth material so as to prevent bacterial growth on an exterior and interior portion of the wristband.

7. The multi-layered wristband of claim 2, wherein the at least one inner layer extends from a distal end of the first portion to about a crease line separating the first portion from the second portion.

8. The multi-layered wristband of claim 7, wherein the one inner layer is made out of moisture absorbing material.

9. The multi-layered wristband of claim 2, wherein the wrist band is configured to transfer sweat exuding from the user's wrist through at least the second layer and trap the sweat into the at least one inner layer, keeping the user's wrist and hand dry.

10. The multi-layered wristband of claim 2, wherein the wristband is configured to fit snugly over the wrist of a user to prevent any sliding of the wristband and gymnastic grip while worn.

11. A multi-layered moisture-wicking sweat-absorbing wristband and gymnastic wristband combination, comprising:

a pair of wrist bands each comprising, a first portion having a first opening, the first portion comprising a first layer, a second layer, and at least two inner layers interposed between the first layer and the second layer, a second portion having a second opening, the second portion comprising a third layer superimposing a fourth layer, wherein the first opening and the second opening are axially aligned and intersect to create a passageway, wherein the first layer, the second layer, the third layer, and the fourth layer are made out of anti-bacterial growth material so as to prevent bacterial growth on an exterior portion of the wristband, and wherein the two inner layers is made out of moisture absorbing material, a pair of gymnastic grips each comprising a palm strip having a pair of finger holes, a wrist strap portion and at least two fastener straps and at least two corresponding fastener buckles extending from the wrist strap portion, wherein the gymnastic wrist strap is wearable and attachable to a wrist using the fastener straps and the fastener buckles, wherein the second portion of the wrist band is foldable onto the first portion at about a crease line, covering the wrist strap portion, the at least two fasteners traps and the at least two corresponding fastener buckles of the gymnastic strap, leaving the palm strap exposed, and wherein the wrist band is configured to transfer sweat exuding from the user's wrist through at least the second layer and trap the sweat into the two inner layers, keeping the user's wrist and hand dry.

* * * * *